United States Patent [19]

Pichelman et al.

[11] Patent Number: 4,486,931

[45] Date of Patent: Dec. 11, 1984

[54] SCARIFYING MACHINE

[75] Inventors: Franklin D. Pichelman, Minnetonka; Perry M. Domaas, Brooklyn Center, both of Minn.

[73] Assignee: Flo-Pac Corporation, Minneapolis, Minn.

[21] Appl. No.: 412,086

[22] Filed: Aug. 27, 1982

[51] Int. Cl.[3] ..... B21C 43/00

[52] U.S. Cl. ..... 29/81 J; 15/93 R; 15/236 C; 241/101.7; 29/81 L

[58] Field of Search ..... 29/81 J, 81 G, 81 H, 29/81 L, 81 A, 81 R; 15/93 R, 93 A, 93 B, 93 C, 236 C; 299/40; 241/101.7, 293

[56] References Cited

U.S. PATENT DOCUMENTS 1,756,734 4/1930 Emminger ..... 125/5
3,678,532 7/1972 Boyd ..... 15/236
4,185,350 1/1980 Fish ..... 29/81 J X

FOREIGN PATENT DOCUMENTS 253687 8/1964 Australia ..... 15/93 R

*Primary Examiner*—Mark Rosenbaum
*Assistant Examiner*—John Burtch
*Attorney, Agent, or Firm*—James R. Haller

[57] ABSTRACT

A scarifying machine is provided with a mounting plate having a plurality of downwardly open wells formed in it adjacent its periphery and that extend above the plane of the plate. Each well is defined and bounded by a pair of downwardly diverging, upwardly smoothly merging internal surfaces rendering the well non-clogging. A plurality of scarifying discs are mounted to the plate with the discs extending upwardly into the wells and downwardly beneath the mounting plate for contact with a floor.

11 Claims, 7 Drawing Figures

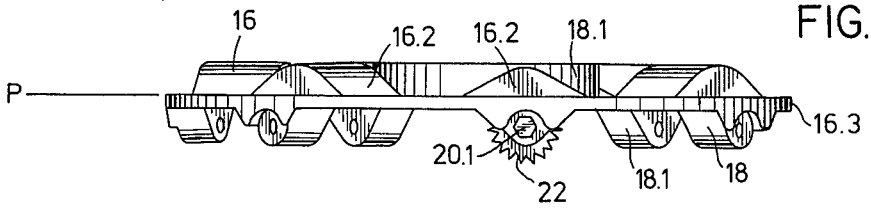
FIG. 4
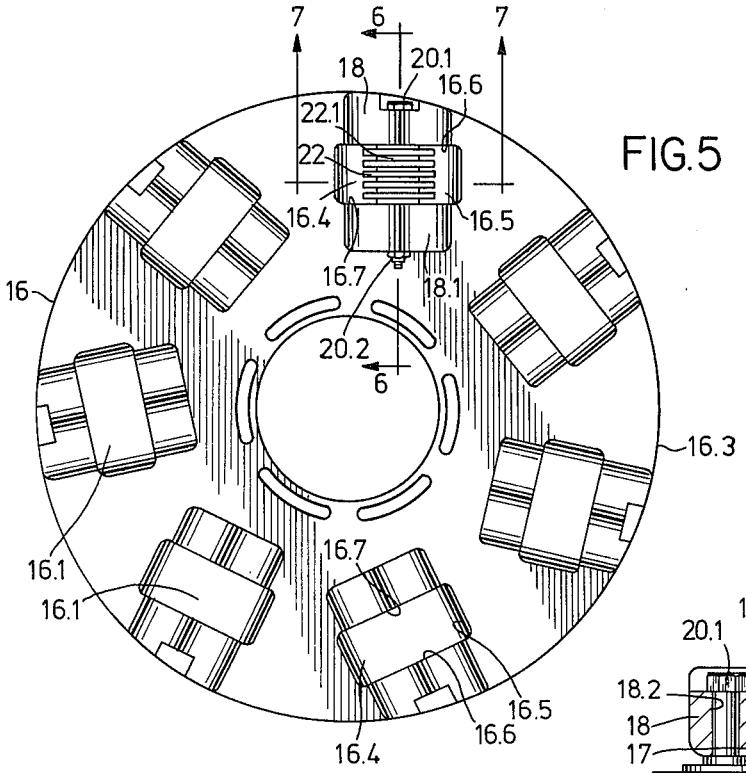
FIG. 5
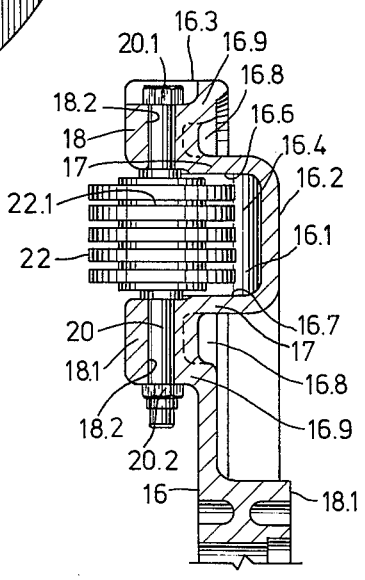
FIG. 6
FIG. 7
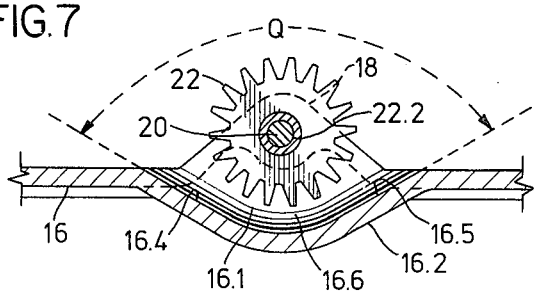

SCARIFYING MACHINE

The invention is in the field of floor treating equipment, and particularly equipment employed for abrading floor surfaces to remove debris.

BACKGROUND OF THE INVENTION

It often becomes necessary to abrade the surface of a floor in order to remove accumulated debris such as wax, dirt, spilled materials such as rubbers and plastics, dried blood and other packing house debris and the like. Various scarifying machines have been developed for this purpose, as exemplified in U.S. Pat. Nos. 4,185,350, 3,678,532, 3,365,772, 3,309,729 and others. Such machines make use, for the most part, of discs having sharpened or pointed peripheries, the discs being mounted to motor-driven rotating plates. The motor driven assembly is usually mounted to a handle in a customary manner.

Commonly, only the abrading discs are in contact with the floor surface to be cleaned. Although scarifying or abrading machines of the type described can quickly remove debris from a floor surface, a great deal of care and often considerable operator strength are required to properly operate such machines. Typically, if the rotating mounting plate is not maintained substantially parallel to the floor surface, discs on one side of the mounting plate will dig with greater force into the floor, causing the machine to develop a rhythmical, "bucking" motion which may be very difficult for an operator to control. Further, the gouging of the discs into the floor surface in this manner may leave unsightly marks in the floor. It will be evident that the bucking motion of a scarifying machine, which often causes the machine to "walk" across a floor, is exceedingly dangerous to the operator. Another problem involves the propensity of certain of such machines to clog up with debris. Rotation of the discs causes debris to be thrown upwardly against the undersurface of the disc mounting plate where it may accumulate to eventually interfere with operation of the machine.

BRIEF DESCRIPTION OF THE INVENTION

It has now been found that the "bucking" that is characteristic of certain prior scarifying machines is due at least in part to the fact that the center of gravity of the rotating portion of the machines is spaced a considerable distance above the level of the floor. This, in turn, permits the rotating mounting plate bearing the discs to be tilted easily with respect to the floor, and the uneven pressure of discs on one side or the other of the rotating plate leads to a rhythmical, cyclic motion of the machine which is difficult to control. The problem is solved, in part, by providing a scarifying machine with rotating parts that are positioned close to the floor surface.

Briefly, the scarifying machine of the invention includes a generally circular mounting plate that lays primarily in a horizontal plane and that is rotatable about a generally vertical axis. A plurality of downwardly open, nonclogging wells are formed in the mounting plate adjacent its periphery, the wells extending above the plane of the plate. Each well is defined and bounded by a pair of downwardly diverging, upwardly merging internal surfaces, and a pair of opposed, generally parallel and vertical surfaces. The invention includes scarifier means comprising a plurality of scarifying discs having abrading peripheries, and means for rotatably mounting the discs to the plate, the discs extending upwardly into the wells and also downwardly beneath the mounting plate for contact with a floor. By virtue of the fact that the discs extend upwardly into the wells which in turn extend above the plane of the mounting plate, the wells are self-cleaning and the mounting plate is closely adjacent the floor surface.

In a preferred embodiment, the means for rotatably mounting the scarifying discs comprises axles onto which the discs are journaled, each axle being mounted to the plate at an angle of from about 5° to about 20° to a radius of the plate intersecting the axle at its center. The downwardly open wells are preferably spaced equi-angularly about and adjacent the periphery of the mounting plate, and the mounting plate desirably includes axle-mounting projections mounted below and at either side of the opposed, generally parallel and vertical interior well surfaces, the mounting projections extending downwardly to a distance from a floor upon which the scarifier discs rest of less than about one-half the diameter of the discs and preferably not more than about one-fourth such diameter, the projections forming, as the plate rotates, a downwardly extending, protective barrier.

DESCRIPTION OF THE DRAWING

FIG. 4 is a side view of the mounting plate of FIG. 1;

FIG. 5 is a bottom view of the mounting plate of FIG. 1, showing scarifier discs in place in one of the wells;

FIG. 6 is a broken-away, cross-sectional view taken along line 6—6 of FIG. 5; and FIG. 7 is a cross-sectional view taken along line 7—7 of FIG. 5.

DESCRIPTION OF THE PREFERRED EMBODIMENTS

Figure 2:
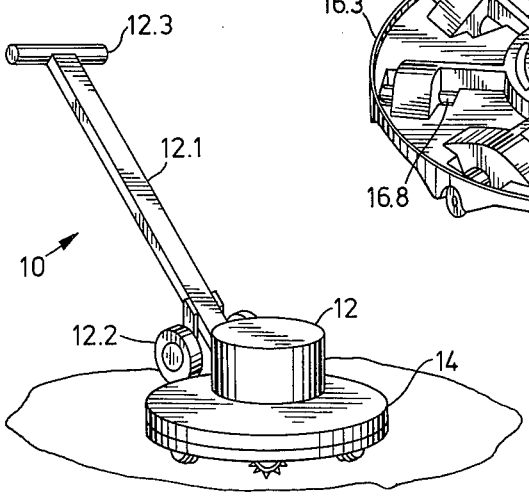
FIG. 2 is a perspective view of a scarifier machine employing the instant invention.

A typical scarifying machine of the invention is depicted in FIG. 2 as (10) and includes a housing (12) within which is mounted an electric motor, a larger, circular housing (14) within which is housed a rotating scarifying device, a handle (12.1) that is normally hinged to the housing (12), and auxilliary wheels (12.2) carried by the handle (12.1). In use, the scarifying machine is operated by an operator grasping the T-shaped member (12.3) at the top of the handle, the operator urging the scarifying machine in one direction or another along the floor to be cleaned. When the machine is to be transported, the handle (12.1) may be depressed to bring the auxilliary wheels (12.2) into contact with the floor and simultaneously raising the scarifying discs from the floor.

A mounting plate 16, shown best in FIGS. 1 and 3–5, is preferably made from aluminum or other rigid and desirably metallic material and lies primarily in a horizontal plane "P" (FIG. 4) parallel to the floor. Formed in the surface of the plate (16) are a plurality of downwardly open, generally elongated wells (16.1), the wells extending upwardly above the plane of the plate as shown at (16.2). The wells preferably are equi-angularly spaced about and adjacent the periphery (16.3) of the mounting plate. Each well is defined and bounded by a pair of downwardly diverging, upwardly smoothly merging internal surfaces (16.4) (16.5) and a pair of opposed, generally parallel and vertical surfaces (16.6), (16.7) that desirably are generally normal to the upwardly merging internal surfaces (16.4), (16.5). The internal surfaces defining the wells desirably smoothly merge at their intersections, each well being free of sharply angled corners in which debris might otherwise lodge. With reference to FIG. 7, the downwardly diverging, upwardly smoothly merging surfaces (16.4), (16.5) forming each well desirably define an angle "Q" between them of from about 110° to about 150°, with a preferred angle being approximately 120°. The trailing wall, which may be either wall (16.4) or (16.5) but more commonly the latter, makes an angle with the vertical of from about 50° to about 70°, with approximately 60° being the preferred angle. In the preferred embodiment, the walls (16.4), (16.5) are substantially symmetrical with respect to the vertical.

Projecting downwardly on either side of the wells (16.1) and generally in line with the interior surfaces (16.6), (16.7) are axle-mounting projections (18), (18.1). The projections (18), (18.1) desirably are smoothly curved, and are provided with aligned apertures (18.2) for receiving axles (20), the latter being depicted in the form of bolts having outer, enlarged heads (20.1) and threaded ends to receive nuts (20.2).

Desirably, the upper surface of the mounting plate (16) is dished downwardly directly above the mounting projections to define upwardly open wells (16.8) on either side of the axle apertures (18.2). This configuration reduces the weight of the mounting plate and provides, in effect, a pair of generally vertical walls (16.9), (17) on either side of the well (16.1) extending downwardly from the plane of the plate to support the mounting projections (18), (18.1), all as shown in FIG. 6.

Scarifier means are typified by peripherally sharpened or pointed discs (22), a plurality of the discs being rotatively mounted on each axle (20) and being spaced one from another by spacers (22.1) (FIG. 6). In a preferred embodiment, the discs are provided with central apertures and are loosely mounted upon a bushing (22.2) carried by and forming part of the axle (20), the central disc apertures having sufficient clearance on the bushing (22.2) as to permit the discs to rotate freely on the axle bushing and to lean slightly with respect to the axis of the axle in one direction or the other. The discs can be of any of the various types known to the art; FIGS. 4 and 7 depict typical discs having a periphery consisting of a series of sharp points. Discs of the type employed in the invention may have sharpened edges, serrated edges or the like, as desired.

Referring to FIG. 5, the generally vertical interior surfaces (16.6) and (16.7) of the wells are generally perpendicular to the axis of the axle (20), and the latter desirably is not radial with respect to the mounting plate but rather is positioned at an angle of from about 5° to about 20° to a radius of the plate that intersects the axle at its center. As a result, as the mounting plate is caused to rotate about its axis, a sliding action is imparted to the discs (22) as the latter rotate upon the floor surface to be cleaned.

As best shown in FIGS. 6 and 7, the discs (22) are carried by the axle (20) so that the discs preferably protrude upwardly into the wells (16.1) above the plane of the mounting plate, and the axle mounting projections (18) extend downwardly below the plane and into close proximity (e.g., not greater than about 8 millimeters or about one-fourth of a disc diameter) from the floor surface. The outer-most mounting projections (16.3) form, as the plate rotates, a downwardly extending, protective barrier for the purpose of restraining one's shoes or the like from extending dangerously beneath the mounting plate and contacting the scarifying discs.

Of importance, the downwardly open wells (16.1) are self-cleaning. Debris that is thrown upwardly within the wells by the rotating discs also is swept from the wells by the discs, and the generally smoothly curved inner surfaces of the wells (16.1) prevents debris from accumulating.

Figure 1:
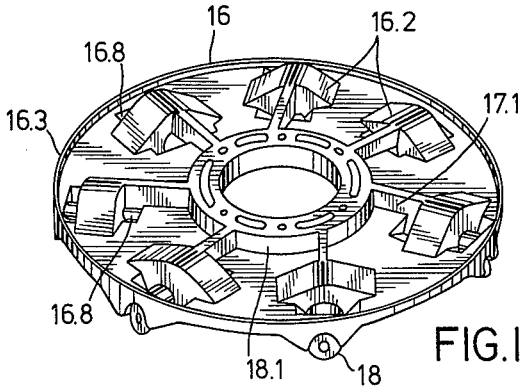
FIG. 1 is a perspective view of a mounting plate employed in a scarifier of the invention.
Figure 3:
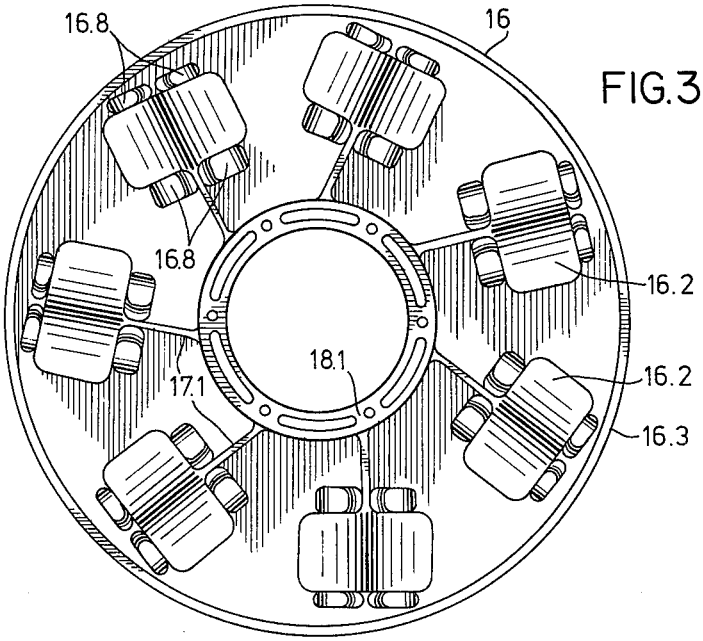
FIG. 3 is a top view of the mounting plate of FIG. 1.

As shown in FIGS. 1 and 3, the upper surface of the mounting plate (16) may be provided with a series of outwardly extending ribs (17.1) that connect the wells (16.1) with a raised, centrally positioned annular boss (17.2), the ribs extending above the innermost mounting projections (18.1) and parallel to the axis of the axles (20) to stiffen and strengthen the mounting plate structure.

Largely because the scarifying discs (22) are carried upwardly within the upwardly extending wells (16.1), the plane of the mounting plate is spaced only a short distance, substantially less than one diameter of the scarifying discs, from the floor to be cleaned, thereby lowering the center of gravity of the scarifying machine and resulting in substantial machine stability and freedom from the pulsating or gyrating effects often found in prior art scarifying machines. The outermost mounting projections serve to restrain one's shoes from entering beneath the machine when it is in use.

While a preferred embodiment of the present invention has been described, it should be understood that various changes, adaptations and modifications may be made therein without departing from the spirit of the invention and the scope of the appended claims.

What is claimed is:

1. A scarifying machine including a generally horizontal, generally circular mounting plate laying primarily in a horizontal plane and rotatable about a generally vertical axis, a plurality of downwardly open, nonclogging wells formed in the mounting plate adjacent its periphery and extending above the plane, each well being defined and bounded by a pair of downwardly diverging, upwardly smoothly merging internal surfaces and a pair of opposed, generally vertical and parallel surfaces, scarifier means comprising a plurality of scarifying discs having abrading peripheries, and means for rotatably mounting the discs to the plate with the discs extending upwardly into the wells and downwardly beneath the mounting plate for contact with a floor, whereby floor debris is cleaned from the wells by rotation of the rotating discs therein and the circular mounting plate is positioned closely adjacent the floor to be cleaned.

2. The scarifying machine of claim 1 wherein the means for rotatively mounting the discs comprise axles onto which the discs are rotatively journaled, each axle being mounted to the plate at an angle of from about 5° to about 20° to a radius of the plate intersecting the axle at its center.

3. The scarifying machine of claim 2 wherein the mounting plate includes axle-mounting projections extending downwardly from the mounting plate adjacent the opposed generally parallel internal surfaces of the well.

4. The scarifying machine of claim 3 wherein the scarifying discs are provided with central, axle-receiving apertures substantially larger in diameter than the axles passing therethrough.

5. The scarifying machine of claim 3 wherein the plate includes a plurality of upwardly open, downwardly extending wells formed therein adjacent the opposed generally parallel internal surfaces of the downwardly open wells, the upwardly open wells having opposed, generally vertical side walls terminating downwardly in said vertical mounting projections beneath the plane of the plate, whereby each such mounting projection is supported by two of said vertical side walls.

6. The scarifying machine of claim 1 wherein the mounting plate includes a central, raised annular boss, the plate including a plurality of ribs extending from the boss outwardly to side walls of the downwardly open wells.

7. The scarifying machine of claim 1 wherein said downwardly open wells are spaced equi-angularly about the periphery of the plate.

8. The scarifying machine of claim 1 wherein the internal surfaces of each downwardly open well smoothly merge at their intersections and wherein each such well is free of sharply angled corners in which debris may lodge.

9. The scarifying machine according to claims 3 or 4 in which the mounting projections nearest the periphery of the mounting plate extend downwardly to a distance from a floor upon which the scarifier discs rest of less than one-half the diameter of the discs to form, as the plate rotates, a downwardly extending protective barrier.

10. The scarifying machine of claim 9 wherein said distance from a floor to the mounting projections nearest the periphery of the mounting plate is not greater than about 8 millimeters.

11. The scarifying machine of claim 1 in which the pair of downwardly diverging, upwardly smoothly merging internal surfaces define between them an angle of from about 110° to about 150°.

* * * * *